US011414879B2

(12) United States Patent
Weaver, IV

(10) Patent No.: US 11,414,879 B2
(45) Date of Patent: Aug. 16, 2022

(54) DUAL-USE FLOORING INSTALLATION DEVICE WITH INTERCHANGEABLE TOOL-ENDS

(71) Applicant: William Bernice Weaver, IV, Pfafftown, NC (US)

(72) Inventor: William Bernice Weaver, IV, Pfafftown, NC (US)

( * ) Notice: Subject to any disclaimer, the term of this patent is extended or adjusted under 35 U.S.C. 154(b) by 416 days.

(21) Appl. No.: 16/812,448

(22) Filed: Mar. 9, 2020

(65) Prior Publication Data

US 2021/0277674 A1 Sep. 9, 2021

(51) Int. Cl.
*E04G 23/00* (2006.01)
*B25D 1/16* (2006.01)

(52) U.S. Cl.
CPC ..... *E04G 23/006* (2013.01); *B25D 1/16* (2013.01)

(58) Field of Classification Search
CPC ..... E04G 23/006; E04F 21/22; B25D 1/16; B25J 1/04; B25B 27/02
USPC ..... 294/8.6, 26, 175; 30/169
See application file for complete search history.

(56) References Cited

U.S. PATENT DOCUMENTS

D272,712 S * 2/1984 Allen ..... D8/89
4,683,631 A * 8/1987 Dobbertin ..... E04F 21/22 29/278
5,245,737 A * 9/1993 Perea ..... B25D 1/16 29/247
5,365,648 A * 11/1994 Fuga ..... B25D 1/02 29/254
5,606,761 A * 3/1997 Lynch ..... B25G 1/04 15/236.1
7,712,199 B1 * 5/2010 Wilson ..... E04F 21/22 29/270
11,142,918 B2 * 10/2021 Alkhafaji ..... E04F 21/22
2002/0178870 A1 * 12/2002 Lowther ..... B25B 27/02 81/27
2010/0313714 A1 * 12/2010 Smith ..... B25B 27/02 254/133 R
2013/0031763 A1 * 2/2013 Kliskey ..... B25B 27/0035 29/426.6
2014/0325765 A1 * 11/2014 Weddle ..... A62B 3/005 7/166

* cited by examiner

*Primary Examiner* — Paul T Chin
(74) *Attorney, Agent, or Firm* — NK Patent Law

(57) ABSTRACT

Dual-use flooring installation device with interchangeable tool-ends includes a pull bar defining a bend at a proximal end and a first connector at a distal end, the bend configured for engaging an end of a flooring material; and a wedge bar defining a wedge at a proximal end and a second connector at a distal end, the wedge configured for insertion between a wall surface or a cabinet surface and a flat material attached thereto. The device further includes a slide hammer unit comprising a hammer weight slidable about a shaft, the slide hammer unit defining an adaptor at a proximal end that is configured for removably attaching to one of the first connector of the pull bar and the second connector of the wedge bar. In a storage mode, the adaptor is disengaged from the pull bar and the wedge bar.

20 Claims, 10 Drawing Sheets

DUAL-USE FLOORING INSTALLATION DEVICE WITH INTERCHANGEABLE TOOL-ENDS

TECHNICAL FIELD

The present invention relates generally to building construction and repairing, and particularly to devices and methods for constructing and repairing floorings.

BACKGROUND

The statements in this section merely provide background information related to the present disclosure and may not constitute prior art.

Flooring installation is a major component of building construction projects, and flooring repair and replacement occur on a periodic basis in existing buildings. During flooring installation, repair and/or replacement projects, there is frequently a need to join adjacent planks, boards, laminate panels, etc. Tools such as jacks are used to apply a force to move elements, such as the planks, boards, laminate panels and the like used in flooring construction and repair applications (these types of elements are referred to herein as a "flooring element"). A flooring element such as tongue and groove plank flooring, for example, requires that the tongue of a first plank be joined with the groove of a second adjacent plank. In the laying of subflooring, covering or decking, a flooring element is placed across the stringers and urged tightly against a previously laid and fastened board to provide good tongue and groove engagement, and thereafter fastened in place, for example, by nailing the board to the stringers. Gaps between adjacent flooring elements need to be eliminated during installation to provide a smooth surface when the job is finished and for years thereafter. Imperfections in dimensions including any of plank, tongue, and groove dimensions increase the difficulty of making gapless joints. For example, a tongue may be slightly oversized such that greater effort is required to mate the tongue in the groove. Additional challenges faced during flooring repairing and replacement work include the difficulty in removing glued elements such as trim, molding, wall base, filler, cover panel, baseboard, and veneers (these types of elements are referred to herein as a "glued element") that are glued to base elements such as sheet rock, woodwork, cabinet and other vertical/horizontal surfaces during floor repair or replacement work (these types of elements are referred to herein as a "base element"). Here, there is a need to carefully remove the glued material in a manner that results in minimal damage to the underlying surface from which the glued material is being removed; otherwise, unsightly and undesirable blemishes and damage can occur to the underlying material surface.

Typically, at least two separate tools are used for accomplishing the above noted functions; for example, a first tool is used for urging adjoining flooring elements, and a second tool is used for removing a glued element from base element. These two or more tools take up space within a worker's toolkit and further require the worker to carry and move around these two or more tools as the worker shits his work location to different spots at a given worksite.

Opportunities exist for providing improvements that increase the efficiencies associated with flooring installation, repair and/or replacement projects.

SUMMARY

This summary is provided to introduce in a simplified form concepts that are further described in the following detailed descriptions. This summary is not intended to identify key features or essential features of the claimed subject matter, nor is it to be construed as limiting the scope of the claimed subject matter.

In accordance with the purposes of the disclosed devices and methods, as embodied and broadly described herein, the disclosed subject matter relates to devices and methods of use thereof. Additional advantages of the disclosed devices and methods will be set forth in part in the description, which follows, and in part will be obvious from the description. The advantages of the disclosed devices and methods will be realized and attained by means of the elements and combinations particularly pointed out in the appended claims. It is to be understood that both the foregoing general description and the following detailed description are exemplary and explanatory only and are not restrictive of the disclosed compositions, as claimed.

The details of one or more embodiments of the invention are set forth in the accompanying drawings and the description below. Other features, objects, and advantages of the invention will be apparent from the description and drawings, and from the claims.

Implementations may include one or more of the following features. Disclosed herein is a dual-use flooring installation device with interchangeable tool-ends. In various embodiments, the device comprises a pull bar defining a bend at a proximal end and a first connector at a distal end, the bend configured for engaging an end of a flooring material. The also comprises a wedge bar defining a wedge at a proximal end and a second connector at a distal end, the wedge configured for insertion between a wall surface or a cabinet surface and a flat material attached thereto. The device further comprises a slide hammer unit comprising a hammer weight slidable about a shaft, the slide hammer unit defining an adaptor at a proximal end that is configured for removably attaching to one of the first connector of the pull bar and the second connector of the wedge bar. In an operational mode, the adaptor of the slide hammer unit engages the pull bar or the wedge bar, and in a storage mode, the adaptor of the slide hammer unit is disengaged from the pull bar and the wedge bar.

In one or more embodiments, the hammer weight weighs between about 5 pounds and about 12 pounds.

In one or more embodiments, the hammer weight is coupled to a handle configured in a spherical shape.

In one or more embodiments, the hammer weight is coupled to a handle configured as a briefcase handle.

In one or more embodiments, the wedge defines a ramped surface increasing in thickness moving from the proximal end of the wedge bar towards a distal end of the wedge bar.

In one or more embodiments, the flat material comprises one or more of trim, molding, wall base, filler, cover panel, baseboard, and veneer.

In one or more embodiments, the first connector and the second connector are configured for sliding in and sliding out of the adaptor.

In one or more embodiments, the first connector and the second connector are configured for attaching to the adaptor by a quick release mechanism.

In one or more embodiments, the quick release mechanism comprises one or more spring-loaded pegs for insertion into openings provided on each of the first connector and the second connector.

In one or more embodiments, the first connector and the second connector are configured for attaching to the adaptor by a bolting mechanism or a screwing mechanism.

In one or more embodiments, the wedge further configured for insertion between a subfloor material and a flat flooring material attached thereto.

In one or more embodiments, at least one major surface of the pull bar or the wedge bar includes one or more protective felt cushions attached thereto.

In one or more embodiments, the one or more protective felt cushions has a circular shape.

In one or more embodiments, the one or more protective felt cushions are configured for compressing when pressure is applied thereto.

In one or more embodiments, at least one major surface of the pull bar or the wedge bar includes a non-surface scratching polyethylene sheathing covering at least a portion of the at least one major surface.

In one or more embodiments, the hammer weight includes a non-surface scratching polyethylene sheathing covering at least a portion of a surface of the hammer weight.

In various embodiments, a method of installing a flooring material using a dual-use flooring installation device with interchangeable tool-ends comprises providing a dual-use flooring installation device with interchangeable tool-ends. The method further comprises removably attaching the adaptor to the second connector of the wedge bar in the operational mode. The method furthermore comprises inserting the wedge between the wall surface or the cabinet surface and a flat material attached thereto. The method also comprises sliding the hammer weight towards the adaptor at the proximal end; and separating at least a portion of the flat material from the wall surface or the cabinet surface.

In one or more embodiments, the method further comprises detaching the adaptor from the second connector of the wedge bar; removably attaching the adaptor to the first connector of the pull bar in the operational mode; engaging the end of the flooring material with the bend of the pull bar; sliding the hammer weight towards the adaptor at the proximal end; and urging the flooring material towards an adjacent flooring material.

In various embodiments, a method of installing a flooring material using a dual-use flooring installation device with interchangeable tool-ends comprises providing a dual-use flooring installation device with interchangeable tool-ends. The method further comprises removably attaching the adaptor to the first connector of the pull bar in the operational mode; and engaging the end of the flooring material with the bend. The method furthermore comprises sliding the hammer weight towards the adaptor at the proximal end; and urging the flooring material towards an adjacent flooring material.

In one or more embodiments, the method further comprises detaching the adaptor from the first connector of the pull bar; and, removably attaching the adaptor to the second connector of the wedge bar in the operational mode. The method furthermore comprises inserting the wedge between the wall surface or the cabinet surface and a flat material attached thereto; sliding the hammer weight towards the adaptor at the proximal end; and separating at least a portion of the flat material from the wall surface or the cabinet surface.

DETAILED DESCRIPTION

Figure 1A:
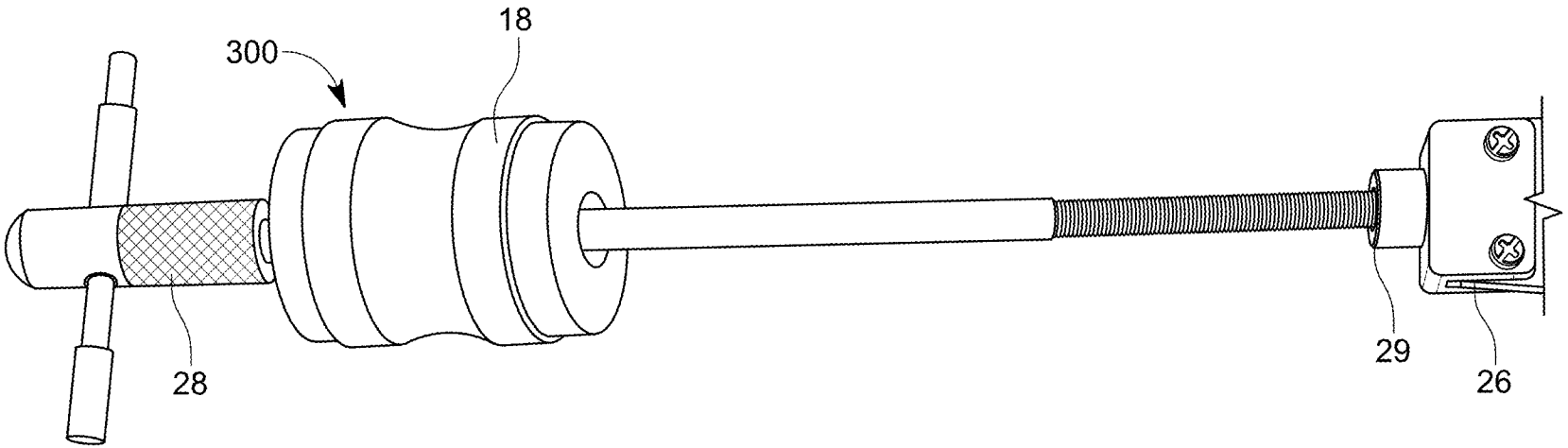
FIG. 1A is a perspective view of a slide hammer unit, according to one or more embodiments of the presently disclosed subject matter.
Figure 1B:
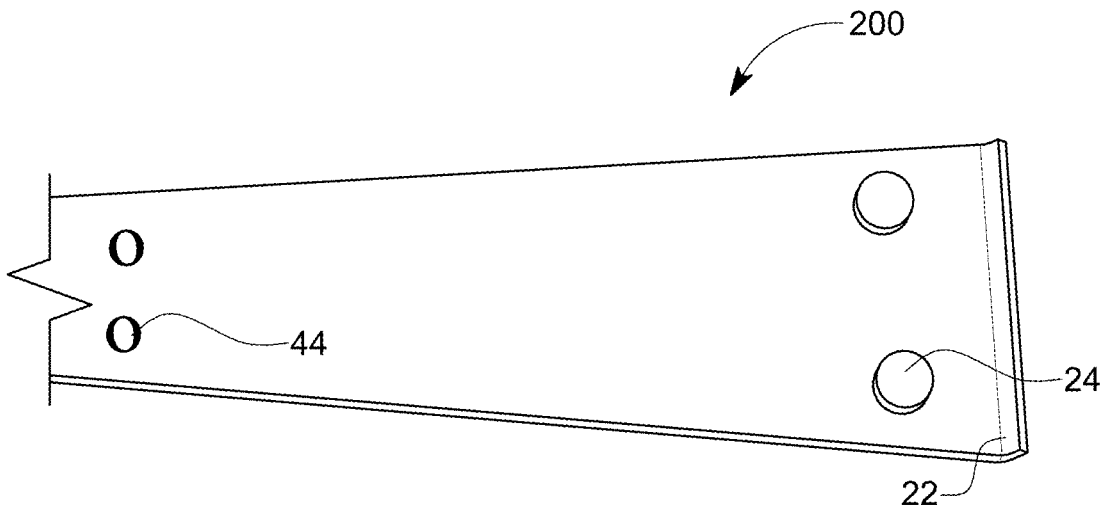
FIG. 1B is a perspective view of a pull bar, according to one or more embodiments of the presently disclosed subject matter.
Figure 1C:
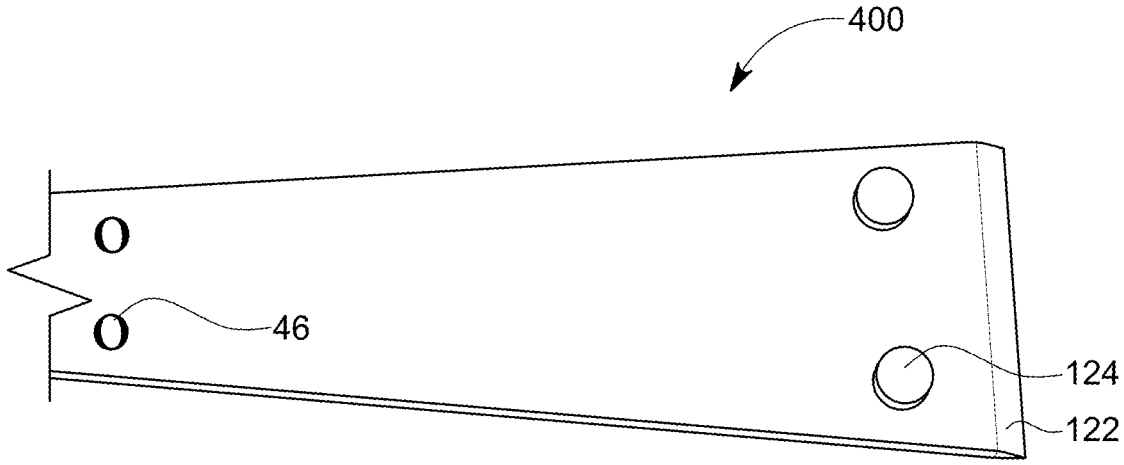
FIG. 1C is a perspective view of a wedge bar, according to one or more embodiments of the presently disclosed subject matter.
Figure 2:
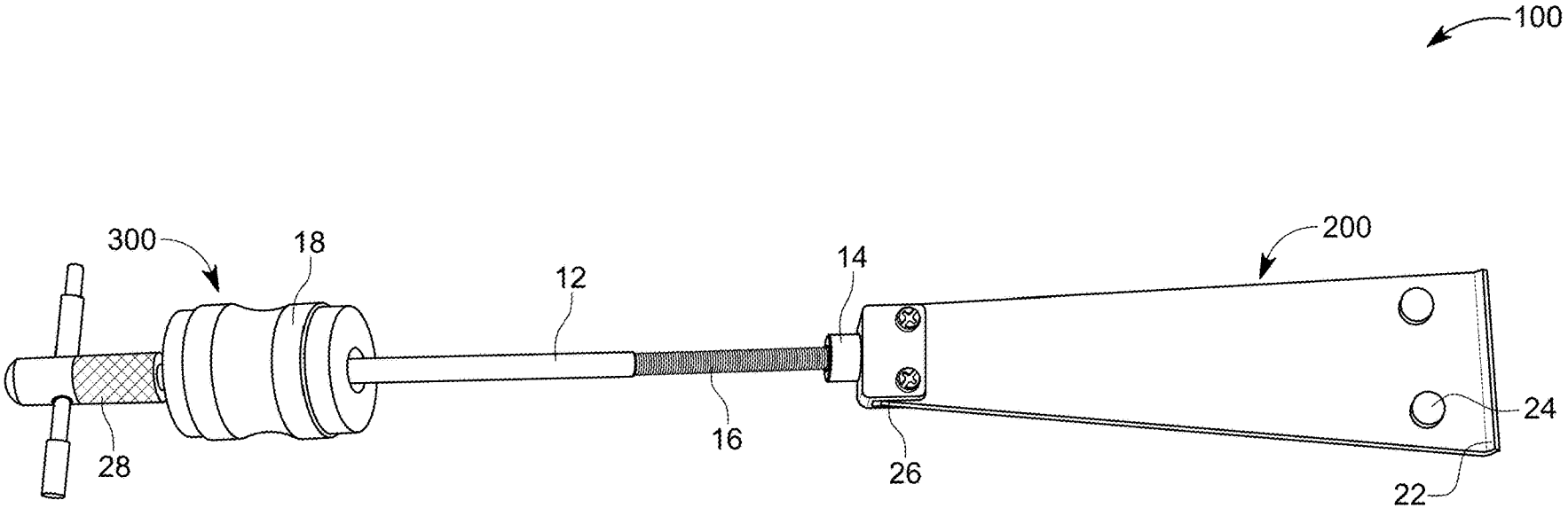
FIG. 2 is a front perspective view of a dual-use flooring installation device with interchangeable tool-ends that includes a slide hammer unit and a pull bar, according to one or more embodiments of the presently disclosed subject matter.
Figure 3:
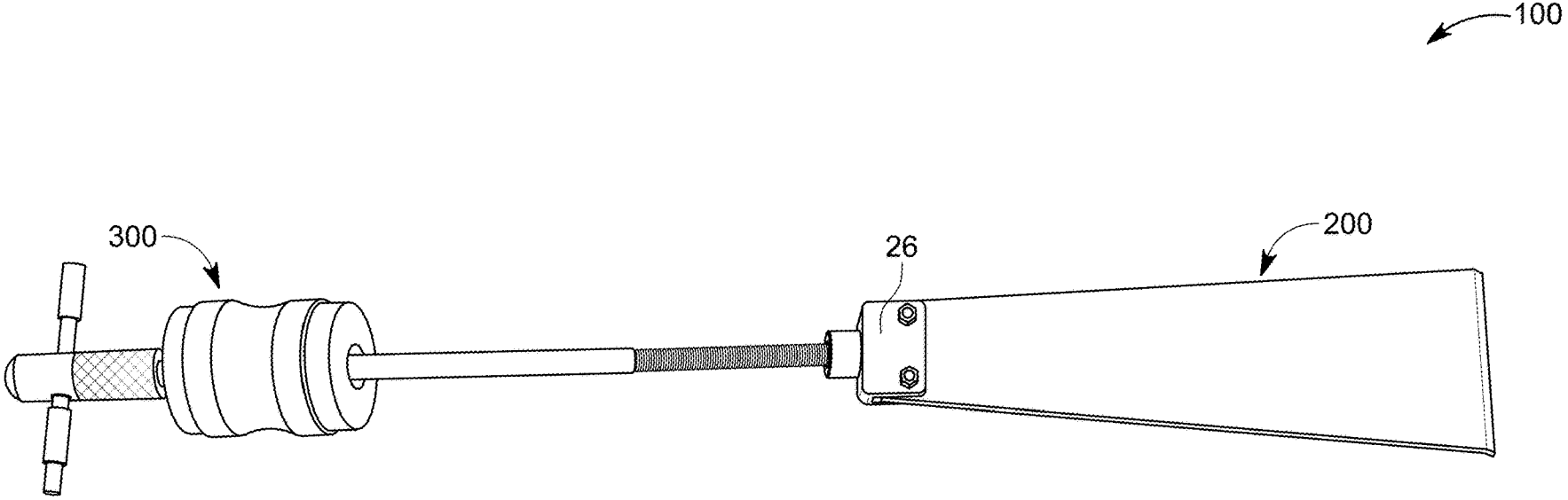
FIG. 3 is a back perspective view of a dual-use flooring installation device with interchangeable tool-ends that includes a slide hammer unit and a pull bar, according to one or more embodiments of the presently disclosed subject matter.
Figure 4:
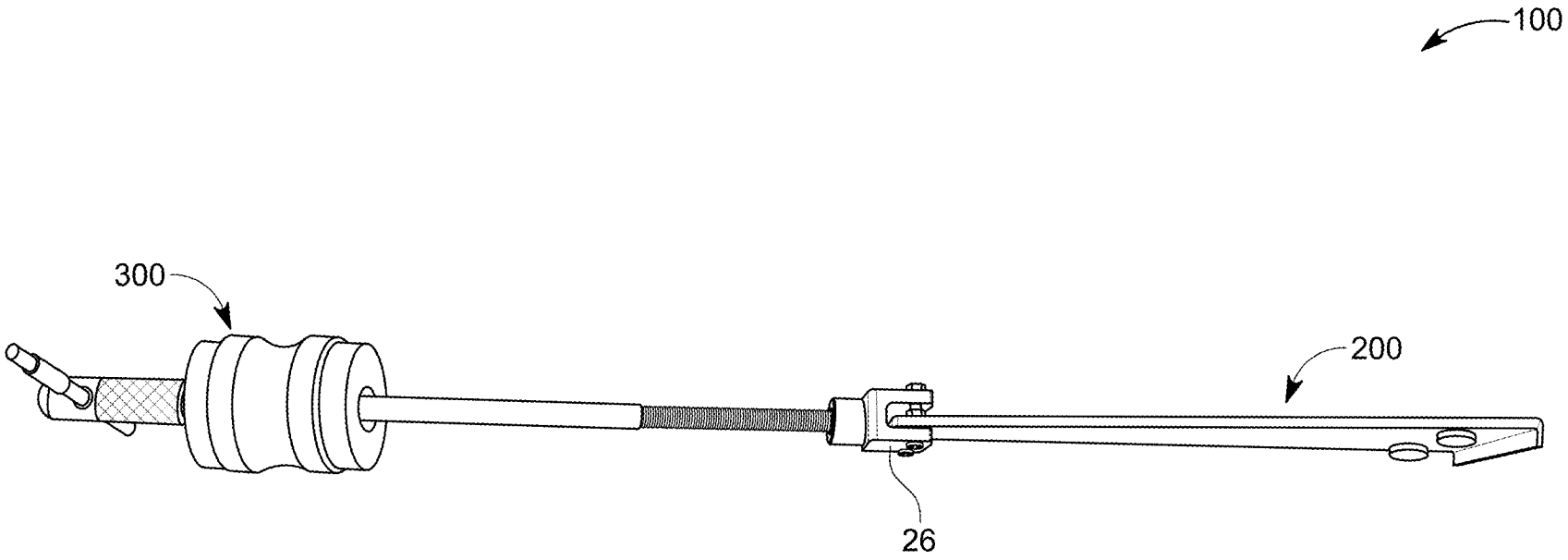
FIG. 4 is a side perspective view of a dual-use flooring installation device with interchangeable tool-ends that includes a slide hammer unit and a pull bar, according to one or more embodiments of the presently disclosed subject matter.
Figure 5:
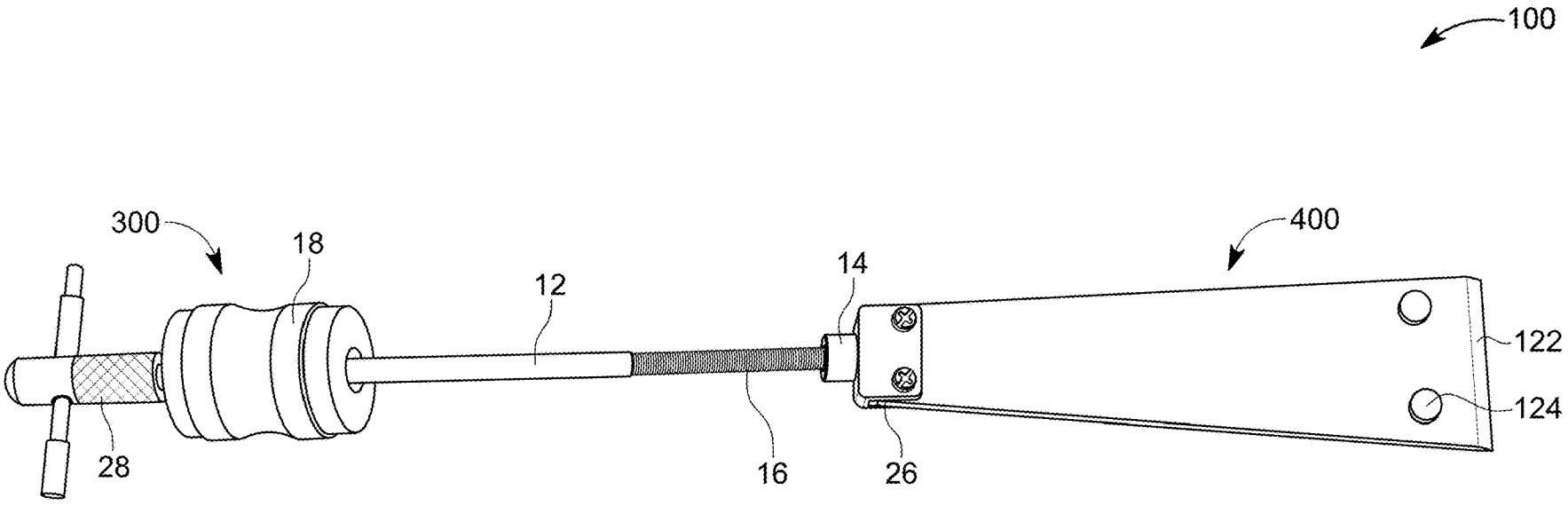
FIG. 5 is a front perspective view of a dual-use flooring installation device with interchangeable tool-ends that includes a slide hammer unit and a wedge bar, according to one or more embodiments of the presently disclosed subject matter.
Figure 6:
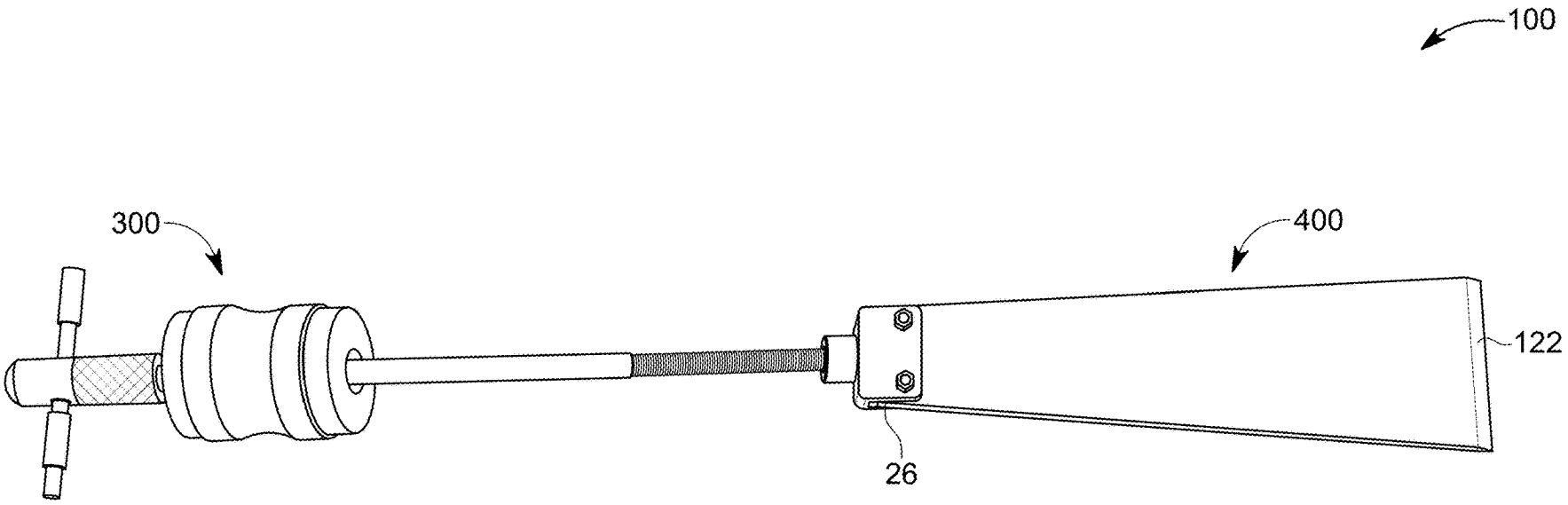
FIG. 6 is a back perspective view of a dual-use flooring installation device with interchangeable tool-ends that includes a slide hammer unit and a wedge bar, according to one or more embodiments of the presently disclosed subject matter.
Figure 7:
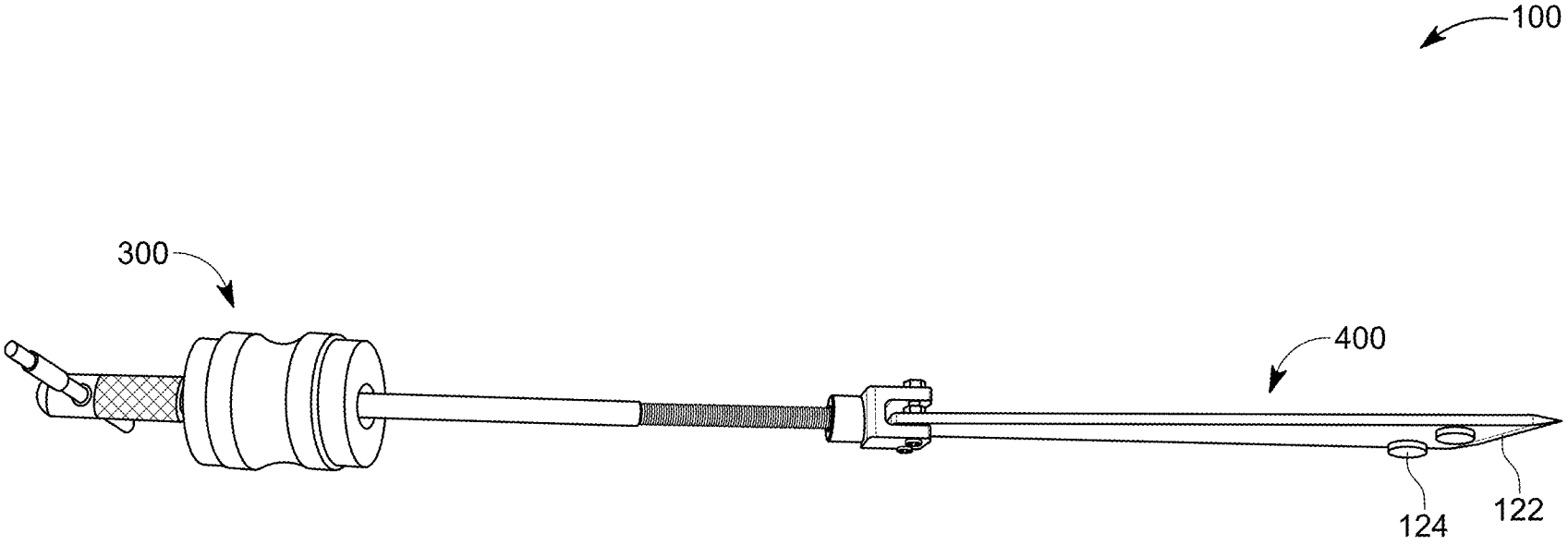
FIG. 7 is a side perspective view of a dual-use flooring installation device with interchangeable tool-ends that includes a slide hammer unit and a wedge bar, according to one or more embodiments of the presently disclosed subject matter.
Figure 8:
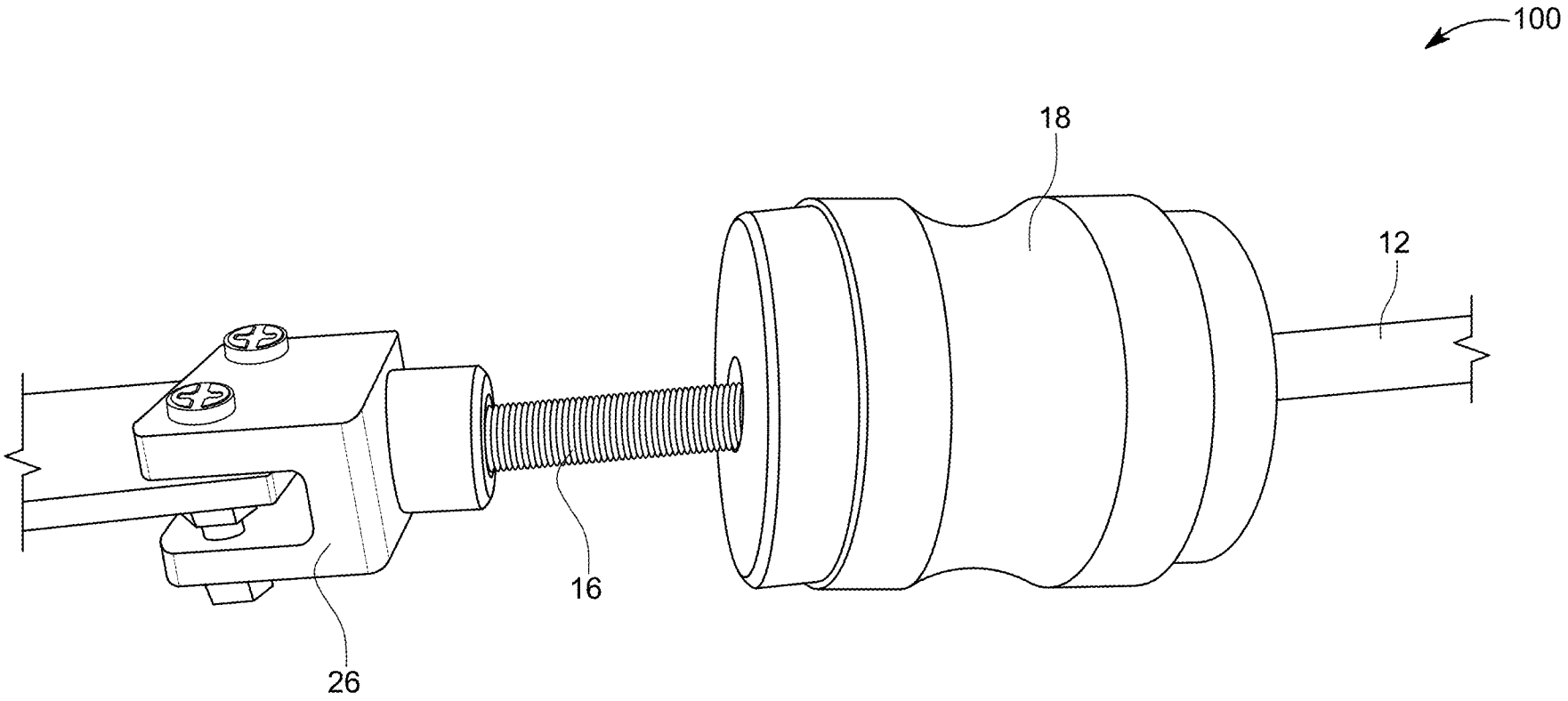
FIG. 8 is a perspective view of a portion of a dual-use flooring installation device with interchangeable tool-ends that illustrating an adaptor and a portion of a slide hammer unit, according to one or more embodiments of the presently disclosed subject matter.
Figure 9:
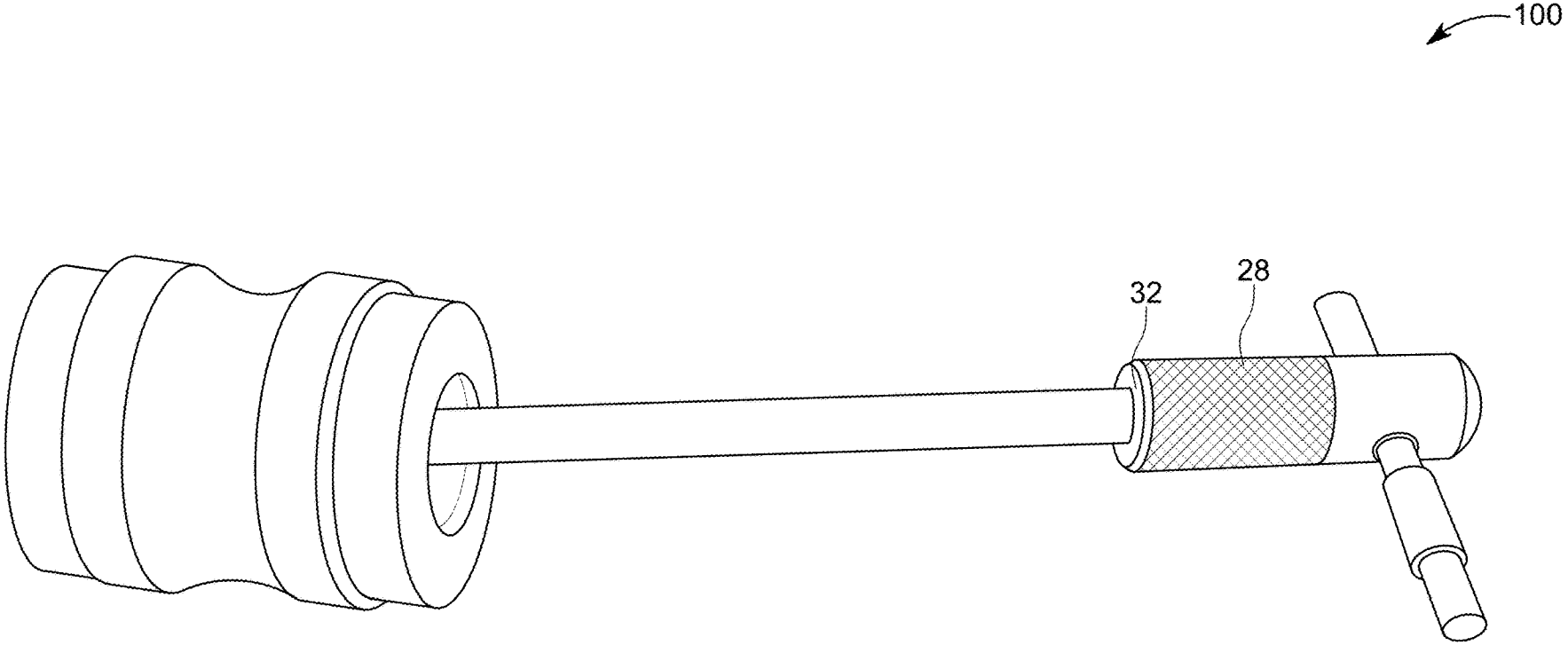
FIG. 9 is a perspective view of a portion of a dual-use flooring installation device with interchangeable tool-ends that illustrating a portion of a slide hammer unit that includes a stopper including a safety collar, according to one or more embodiments of the presently disclosed subject matter.

The following description and drawings are illustrative and are not to be construed as limiting. Numerous specific details are described to provide a thorough understanding of the disclosure. However, in certain instances, well-known or conventional details are not described in order to avoid obscuring the description. References to "one embodiment" or "an embodiment" in the present disclosure can be, but not necessarily are, references to the same embodiment and such references mean at least one of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way.

Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only, and is not intended to further limit the scope and meaning of the disclosure or of any exemplified term. Likewise, the disclosure is not limited to various embodiments given in this specification.

Without intent to limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

Embodiments of the presently disclosed subject matter advantageously provide for a dual-use flooring installation device with interchangeable tool-ends. According to various embodiments, as illustrated in FIGS. 1 through 9, a dual-use flooring installation device with interchangeable tool-ends 100 (alternately referred to herein as "device 100" or simply "device") comprises a pull bar 200 defining a bend 22 at a proximal end and a first connector at a distal end. Bend 22 is configured for engaging an end of a flooring material. Device 100 further comprises a wedge bar 400 defining a wedge 122 at a proximal end and a second connector at a distal end. Wedge 122 is configured for insertion between a wall surface or a cabinet surface and a flat material attached thereto. The flat material can comprise trim, molding, wall base, filler, cover panel, baseboard, veneer and/or combinations thereof. In various embodiments, wedge 122 defines a ramped surface increasing in thickness moving from the proximal end of the wedge bar towards a distal end of the wedge bar (the distal end of the wedge bare includes the connectors while the proximal end includes the wedge). The wedge can be configured for advantageously inserting between a subfloor material and a flat flooring material attached thereto.

Device 100 further comprises a slide hammer unit 300 comprising a hammer weight 18 slidable about shaft 12. In one embodiment, hammer weight 18 is formed of forged steel. In one embodiment, hammer weight 18 is constructed of chrome vanadium steel for smooth operation, improved durability, and corrosion resistance. Slide hammer unit 300 defines an adaptor 26 at a proximal end 29 that is located opposite to the distal end that includes stopper 28 of slide hammer unit 300. In one embodiment, shaft 12 includes threaded section 16 at proximal end 29, wherein threaded section 16 is screwed into a complimenting threaded receptacle provided on adaptor 26. However, shaft 12 can be coupled to adaptor 26 by any commonly known means such as nut and bolts, welding, or a similar other mechanism. In one embodiment, adaptor 26 and shaft 12 can be molded as one singular unit. In the same embodiment or in a different embodiment, shaft 12 includes stopper 28 at the distal end that operates to prevent hammer weight 18 from sliding out of shaft 12. Shaft 12 can include grooves or threads for adjusting the height of the device 100; for example, in one embodiment, a screwed-in pin provided on shaft 12 can be used to adjust the height of device 100. In one embodiment, stopper 28 includes a "T-handle" as shown in FIG. 1A, for example, to provide a secure grip. In some embodiments, stopper 28 includes a safety collar 32 that prevents any inadvertent injury causable to an operator's hand from hammer weight 18 when hammer weight 18 is slid back and forth along shaft 12 in the operational mode.

Adaptor 26 is configured for removably attaching to one of the first connector 44 of the pull bar and the second connector 46 of the wedge bar. Accordingly, in an operational mode, adaptor 26 of the slide hammer unit engages the pull bar 200 or the wedge bar 400. In one orientation of the operational mode, adaptor 26 of the slide hammer unit engages the pull bar 200 via one or more first connectors 44; in another orientation of the operational mode, adaptor 26 of the slide hammer unit engages the wedge bar 400 via one or more second connectors 46. However, adaptor 26 can be removably attached to first connectors 44 and second connectors 46 by any other commonly known means. For example, in one embodiment, each of the first and second connector can be configured for removably attaching to adaptor 26 by a tongue and groove set up; according to such an embodiment, the first/second connector can slide into a groove provided on adaptor 26 and locked in position by a locking mechanism such as, for example, a spring loaded locking pin. The first connector and the second connector can thereby be configured for sliding in and sliding out of the adaptor.

In some embodiments, the first connector and the second connector are configured for attaching to the adaptor by any quick release mechanism as is commonly known to persons of skill in the relevant art. For example, in some embodiments, the quick release mechanism can be in the form of quick release button that is capable of releasing the attachment between the first/second connector and the adaptor when the button is pushed in or manipulated in some other way. In some embodiments, the quick release mechanism can comprise one or more spring-loaded pegs for insertion into openings provided on, or in the form of, the first connector and the second connector. In some embodiments, the first connector and the second connector are configured for attaching to the adaptor by a bolting mechanism (e.g., a bolt and nut) or a screwing mechanism.

In a storage mode, the slide hammer unit 300 is disengaged from the pull bar 200 and the wedge bar 400. Accordingly, in the storage mode, device 100 comprises three separate components namely slide hammer unit 300, pull bar 200, and wedge bar 400. Embodiments of the presently disclosed subject matter can advantageously provide for the device 100 requiring minimal storage space in its storage mode by providing for the dismantling of device 100 into at least three constituent parts namely slide hammer unit 300, pull bar 200, and wedge bar 400.

In one embodiment, pull bar 200 and wedge bar 400 are of the same height. In one embodiment, pull bar 200 is shorter than the wedge bar 400. In one embodiment, pull bar 200 is taller than the wedge bar 400. In one embodiment, adaptor 26 is configured for removably attaching to both first connector(s) 44 and second connector(s) 46. In this embodiment, wedge bar 400 is configured for sliding up (rather than having to be disconnected or disengaged from slide hammer unit 300) while pull bar 200 is being used in the operational mode. In this embodiment, adaptor 26 can be provided with an opening to allow wedge bar 400 to slide up; adaptor 26 can be further provided with a locking mechanism to lock the slid up wedge bar 400 in a locked position such that it does not inadvertently slide down or slide out when pull bar is being used in the operational mode. In one embodiment, pull bar 200 is configured for sliding up (rather than having to be disconnected or disengaged from slide hammer unit 300) while wedge bar 400 is being used in the operational mode, with adaptor 26 being provided with a complimentary opening and a locking mechanism as explained above; in one embodiment the width of wedge bar 400 is narrower than the width of pull bar 200 so that pull bar 200 can occupy less space in its slid up configuration.

In one embodiment, during operations, after bend 22 of pull bar 200 engages the edge of a flooring material, hammer weight 18 can be slid along shaft 12 to hammer against (i.e., to slam or hit against) stopper 28 to thereby urge the flooring material to move in a direction parallel to the direction of movement of hammer weight 18 to form a tight or tighter alignment with an adjacent flooring material to thereby provide for a better fitting together of adjacent flooring materials. In one embodiment, during operations, after wedge 122 of wedge bar 400 is inserted between a wall surface or a cabinet surface and a flat material attached thereto, hammer weight 18 can be slid along shaft 12 to hammer against (i.e., to slam or hit against) adaptor 26 to thereby separate the flat material from the wall/cabinet surface. However, the hammer weight 18 can be manipulated as needed by slamming against stopper 28 or against adaptor 26, as needed, with either pull bar 200 or wedge bar 400 attached to adaptor 26.

In various embodiments, hammer weight 18 can have a mass of between about 5 pounds and about 12 pounds. However, this range is in no way limiting and the hammer weight can be configured to be of any suitable mass as required by the application at hand. In various embodiments, hammer weight 18 can include a handling means for moving the hammer weight about shaft 12 during the operational mode. In one embodiment, the handling means can be in the shape that is similar to that of the gear shift knob provided in a car. In one embodiment, the handle is configured in a spherical shape, with the spherical shaped handle being connected to the hammer by a suitable means such as, for example, a cylindrical metal rod. In some embodiments, hammer weight 18 can be coupled to a handle configured as a briefcase handle as is well known in the relevant art. In one embodiment, the briefcase handle can have a width of 6.2 inches, a height of 2.8 inches, and a diameter of 1.75 inches. The briefcase handle can attach to the hammer weight at two places. In one embodiment, the briefcase handle can be constructed of steel with nickel plating. A black plastic grip material may extend over the nickel plating. In one embodiment, the hammer weight 18 can have flat sides instead of curved disposition as illustrated in the Figures.

In various embodiments, at least one major surface of the pull bar or the wedge bar includes one or more protective cushions 24 and/or protective cushions 124 attached thereto. In some embodiments, the protective cushions are configured for compressing when pressure is applied thereto. In some embodiments, the protective cushions can be formed of felt. In some other embodiments, the protective cushions can be in the form a small bellow that is configured for compressing when pressure is applied thereto. In some embodiments, the protective cushions can be formed of any suitable material that can compress when pressure is applied thereto. In various embodiments, the protective cushions can be glued onto a major surface of the pull bar and/or the wedge bar. In some embodiment, the protective felt cushions can have a circular shape. The protective cushions advantageously operate to protect the surface that comes in contact with the wedge bar or the pull bar to thereby prevent scratching or similar other damage thereto when the device 100 is being operated during the operational mode. Accordingly, embodiments of the presently disclosed subject matter can include one or more felt buttons or felt tabs to prevent or minimize damage to the surface against which the felt facing side is juxtaposed.

In some embodiments, at least one major surface of the pull bar or the wedge bar includes a non-surface scratching polyethylene sheathing covering at least a portion of the at least one major surface. The polyethylene sheathing can serve the same purpose as the protective cushions; in other words, the polyethylene sheathing can advantageously operate to protect the surface that comes in contact with the wedge bar or the pull bar to thereby prevent scratching or similar other damage thereto when the device 100 is being operated during the operational mode.

According to various embodiments of the presently disclosed subject matter, a method of installing a flooring material using a dual-use flooring installation device with interchangeable tool-ends includes providing a dual-use flooring installation device with interchangeable tool-ends as described herein. The device 100 comprises a pull bar defining a bend at a proximal end and a first connector at a distal end, the bend configured for engaging an end of a flooring material. The device 100 further comprises a wedge bar defining a wedge at a proximal end and a second connector at a distal end, the wedge configured for insertion between a wall surface or a cabinet surface and a flat material attached thereto. The device 100 also comprises a slide hammer unit comprising a hammer weight slidable about a shaft, the slide hammer unit defining an adaptor at a proximal end that is configured for removably attaching to one of the first connector of the pull bar and the second connector of the wedge bar. In an operational mode, the adaptor of the slide hammer unit engages the pull bar or the wedge bar, and in a storage mode, the slide hammer unit is disengaged from the pull bar and the wedge bar. The method further comprises removably attaching the adaptor to the second connector of the wedge bar in the operational mode. The method furthermore comprises inserting the wedge between the wall surface or the cabinet surface and a flat material attached thereto. The method also comprises sliding the hammer weight towards the adaptor at the proximal end and separating at least a portion of the flat material from the wall surface or the cabinet surface.

In some embodiments, the method further comprises detaching the adaptor from the second connector of the wedge bar, removably attaching the adaptor to the first connector of the pull bar in the operational mode, engaging the end of the flooring material with the bend of the pull bar, sliding the hammer weight towards the adaptor at the proximal end, and urging the flooring material towards an adjacent flooring material.

In one embodiment, the method comprises removably attaching the adaptor to the first connector of the pull bar in the operational mode. The method further comprises engaging the end of the flooring material with the bend, sliding the hammer weight towards the adaptor at the proximal end, and urging the flooring material towards an adjacent flooring material.

In some embodiments, the method further comprises detaching the adaptor from the first connector of the pull bar, removably attaching the adaptor to the second connector of the wedge bar in the operational mode, inserting the wedge between the wall surface or the cabinet surface and a flat material attached thereto, sliding the hammer weight towards the adaptor at the proximal end, and separating at least a portion of the flat material from the wall surface or the cabinet surface.

Embodiments of the presently disclosed subject matter can be advantageously used in work involving flooring elements, glued elements and base elements as mentioned herein. Embodiments of the presently disclosed subject matter can be advantageously used by professionals as well as do-it-yourself (DIY) folks. Embodiments of the presently disclosed subject matter can help in advantageously ensuring that laminate pieces are firmly joined. Embodiments can advantageously be used at room ends when pushing a row of laminate below the door frame. Embodiments of the presently disclosed subject matter can provide for a professional tool that can make the installation of interlocking floors quick and easy. Embodiments of the presently disclosed subject matter can virtually eliminate damage to walls and cabinets, reaching easily under toe-kicks and other low spaces when installing the last board in a row. Embodiments of the presently disclosed subject matter can used to apply full force horizontally to the board to be moved. Embodiments of the presently disclosed subject matter can prevent damage to flooring materials and further provide for the proper installation of flooring materials for years of enjoyment. Embodiments of the presently disclosed subject matter can be used for installing laminates, engineered woods, hardwoods, and similar other materials.

Downward blows to typical wedges available in the market to detach flat materials (e.g., trim, molding, wall base, filler, cover panel, baseboard, and veneer) can cause damage to the various surfaces, leaving a dent in them. Embodiments of the presently disclosed subject matter can prevent or minimize such damage and provide for the optimal flooring installation conditions. Embodiments of the presently disclosed subject matter can be advantageously used to remove laminate tiles, and side strips on walls.

The embodiments as described herein are intended to be for illustrative purposes to disclose the intent of the design. Changes to design, geometry and operational processes could be carried out without digressing from the overall intent of the design.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A dual-use flooring installation device with interchangeable tool-ends, the device comprising:

a pull bar defining a bend at a proximal end and a first connector at a distal end, the bend configured for engaging an end of a flooring material;

a wedge bar defining a wedge at a proximal end and a second connector at a distal end, the wedge configured for insertion between a wall surface or a cabinet surface and a flat material attached thereto;

a slide hammer unit comprising a hammer weight slidable about a shaft, the slide hammer unit defining an adaptor at a proximal end that is configured for removably attaching to one of the first connector of the pull bar and the second connector of the wedge bar;

wherein, in an operational mode, the adaptor of the slide hammer unit engages the pull bar or the wedge bar, and wherein, in a storage mode, the adaptor of the slide hammer unit is disengaged from the pull bar and the wedge bar.

2. The device of claim 1, wherein the hammer weight weighs between about 5 pounds and about 12 pounds.

3. The device of claim 1, wherein the hammer weight is coupled to a handle configured in a spherical shape.

4. The device of claim 1, wherein the hammer weight is coupled to a handle configured as a briefcase handle.

5. The device of claim 1, wherein the wedge defines a ramped surface increasing in thickness moving from the proximal end of the wedge bar towards a distal end of the wedge bar.

6. The device of claim 1, wherein the flat material comprises one or more of trim, molding, wall base, filler, cover panel, baseboard, and veneer.

7. The device of claim 1, wherein the first connector and the second connector are configured for sliding in and sliding out of the adaptor.

8. The device of claim 1, wherein the first connector and the second connector are configured for attaching to the adaptor by a quick release mechanism.

9. The device of claim 8, wherein the quick release mechanism comprises one or more spring-loaded pegs for insertion into openings provided on each of the first connector and the second connector.

10. The device of claim 1, wherein the first connector and the second connector are configured for attaching to the adaptor by a bolting mechanism or a screwing mechanism.

11. The device of claim 1, wherein the wedge further configured for insertion between a subfloor material and a flat flooring material attached thereto.

12. The device of claim 1, wherein at least one major surface of the pull bar or the wedge bar includes one or more protective felt cushions attached thereto.

13. The device of claim 12, wherein the one or more protective felt cushions has a circular shape.

14. The device of claim 12, wherein the one or more protective felt cushions are configured for compressing when pressure is applied thereto.

15. The device of claim 1, wherein at least one major surface of the pull bar or the wedge bar includes a non-surface scratching polyethylene sheathing covering at least a portion of the at least one major surface.

16. The device of claim 1, wherein the hammer weight includes a non-surface scratching polyethylene sheathing covering at least a portion of a surface of the hammer weight.

17. A method of installing a flooring material using a dual-use flooring installation device with interchangeable tool-ends, the method comprising:

providing a dual-use flooring installation device with interchangeable tool-ends, the device comprising:

a pull bar defining a bend at a proximal end and a first connector at a distal end, the bend configured for engaging an end of a flooring material;

a wedge bar defining a wedge at a proximal end and a second connector at a distal end, the wedge configured for insertion between a wall surface or a cabinet surface and a flat material attached thereto;

a slide hammer unit comprising a hammer weight slidable about a shaft, the slide hammer unit defining an adaptor at a proximal end that is configured for removably attaching to one of the first connector of the pull bar and the second connector of the wedge bar;

wherein, in an operational mode, the adaptor of the slide hammer unit engages the pull bar or the wedge bar, and wherein, in a storage mode, the adaptor of the slide hammer unit is disengaged from the pull bar and the wedge bar;

removably attaching the adaptor to the second connector of the wedge bar in the operational mode;

inserting the wedge between the wall surface or the cabinet surface and a flat material attached thereto;

sliding the hammer weight towards the adaptor at the proximal end; and separating at least a portion of the flat material from the wall surface or the cabinet surface.

18. The method of claim 17, further comprising:

detaching the adaptor from the second connector of the wedge bar;

removably attaching the adaptor to the first connector of the pull bar in the operational mode;

engaging the end of the flooring material with the bend of the pull bar;

sliding the hammer weight towards the adaptor at the proximal end; and urging the flooring material towards an adjacent flooring material.

19. A method of installing a flooring material using a dual-use flooring installation device with interchangeable tool-ends, the method comprising:

providing a dual-use flooring installation device with interchangeable tool-ends, comprising:

a pull bar defining a bend at a proximal end and a first connector at a distal end, the bend configured for engaging an end of a flooring material;

a wedge bar defining a wedge at a proximal end and a second connector at a distal end, the wedge configured for insertion between a wall surface or a cabinet surface and a flat material attached thereto;

a slide hammer unit comprising a hammer weight slidable about a shaft, the slide hammer unit defining an adaptor at a proximal end that is configured for removably attaching to one of the first connector of the pull bar and the second connector of the wedge bar;

wherein, in an operational mode, the adaptor of the slide hammer unit engages the pull bar or the wedge bar, and wherein, in a storage mode, the adaptor of the slide hammer unit is disengaged from the pull bar and the wedge bar;

removably attaching the adaptor to the first connector of the pull bar in the operational mode;

engaging the end of the flooring material with the bend;

sliding the hammer weight towards the adaptor at the proximal end; and urging the flooring material towards an adjacent flooring material.

20. The method of claim 19, further comprising:

detaching the adaptor from the first connector of the pull bar;

removably attaching the adaptor to the second connector of the wedge bar in the operational mode;

inserting the wedge between the wall surface or the cabinet surface and a flat material attached thereto;

sliding the hammer weight towards the adaptor at the proximal end; and separating at least a portion of the flat material from the wall surface or the cabinet surface.

* * * * *